US006475026B1

(12) United States Patent
Tseng et al.

(10) Patent No.: US 6,475,026 B1
(45) Date of Patent: Nov. 5, 2002

(54) FLAT FLEXIBLE CABLE CONNECTOR

(75) Inventors: Gwou-Jong Tseng; Fu-Kai Tsai, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/014,624

(22) Filed: Dec. 10, 2001

(51) Int. Cl.[7] ..... H01R 13/73
(52) U.S. Cl. ..... 439/495; 439/578
(58) Field of Search ..... 439/495, 329, 439/570

(56) References Cited

U.S. PATENT DOCUMENTS 5,863,217 A * 1/1999 Ii et al. ..... 439/495
6,276,958 B1 * 8/2001 Chih ..... 439/495
6,280,240 B1 * 8/2001 Chang ..... 439/495
6,315,602 B1 * 11/2001 Miura et al. ..... 439/495
6,319,052 B1 * 11/2001 Chang ..... 439/495

* cited by examiner

*Primary Examiner*—Gary Paumen
(74) *Attorney, Agent, or Firm*—Wei Te Chung

(57) ABSTRACT

A Flexible Flat Cable (FFC) connector (1) includes an insulative housing (2), a number of electrical contacts (3) accommodated in the insulative housing, an actuator (4) and a pair of mounting pads (5) retained to the insulative housing. The insulative housing has a receiving cavity (203) and a pair of guiding holes (220). The actuator includes a tongue (400) extending into the receiving cavity to press an inserted flexible flat cable (6) to electrically connect with the electrical contacts and a pair of side latches (44) extending into the guiding holes. The side latches have projections (441) engageable with stoppers (221) of the insulative housing to locate the FFC connector in an open position and recesses (442) engageable with latch blocks (224) of the insulative housing to locate the FFC connector in a closed position.

1 Claim, 12 Drawing Sheets

FLAT FLEXIBLE CABLE CONNECTOR

BACKGROUND OF THE INVENTION

1. Field of the Invention

The present invention relates to an electrical connector, and particularly to a flat flexible cable (FFC) connector.

2. Description of the Prior Art

Flat flexible cables (FFCs) are widely used to connect components, such as a printed circuit board, arranged in a confined space inside an electronic device, such as a computer, for reducing the overall size of the electronic device. An FFC may be directly connected to a circuit board by soldering. Alternatively, an FFC connector may be used to connect an FFC to a circuit board.

A conventional FFC connector usually comprises an insulative housing defining a receiving cavity for movably receiving an actuator. The actuator has a tongue insertable into the receiving cavity and a top face for retaining a leading end of a flat flexible cable whereby when the tongue is inserted into the cavity, the flat flexible cable engages with resilient arms of electrical contacts accommodated in the receiving cavity. Two side latches are formed on opposite ends of the actuator and each side latch is formed with an inwardly extending barb on a free end thereof. The barb respectively engages with a projection and a stop formed in a guiding slot of the insulative housing to retain the actuator at a closed position and an open position, respectively.

Since the barbs of the side latches engages with both the projections and the stops of the insulative housing to respectively locate the FFC connector at the closed and the open positions, it is apt for them to yield or even be destroyed after long-term insertion/retreating of the actuator into/from the receiving cavity of the insulative housing, thereby interrupting the electrical connection between the electrical contacts and the inserted FFC.

Therefore, an improved FFC connector is desired to overcome the disadvantages of the prior art.

SUMMARY OF THE INVENTION

A major object of the present invention is to provide an FFC connector having long-term durable side latches.

An FFC connector in accordance with the present invention comprises an insulative housing, a plurality of electrical contacts, an actuator and a pair of mounting pads retained to the insulative housing. The insulative housing defines a receiving cavity and a pair of guiding holes beside the receiving cavity. The electrical contacts are accommodated in the insulative housing and each has an arm extending into the receiving cavity. The actuator comprises a tongue extending into the receiving cavity to press an inserted FFC against the arms of the electrical contacts and a pair of side latches extending into the guiding holes. Each side latch comprises a projection engageable with a stopper of the insulative housing to locate the FFC connector in an open position and a recess engageable with a latch block of the insulative housing to locate the FFC connector in a closed position.

Other objects, advantages and novel features of the invention will become more apparent from the following detailed description of the present embodiment when taken in conjunction with the accompanying drawings.

DETAILED DESCRIPTION OF THE INVENTION

Figure 1:
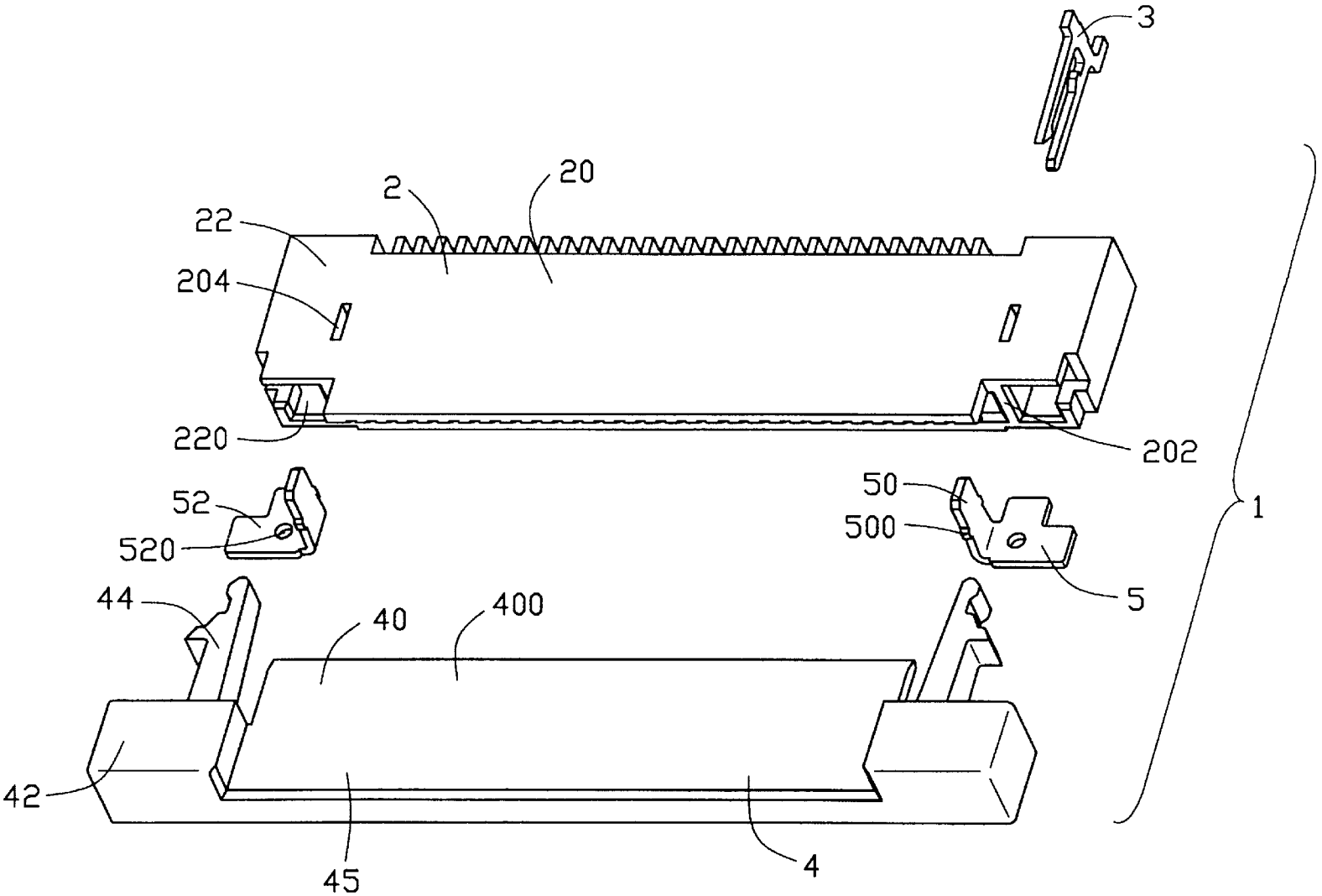
FIG. 1 is a partially exploded view of an FFC connector in accordance with the present invention with all but one electrical contact being assembled to an insulative housing thereof.
Figure 2:
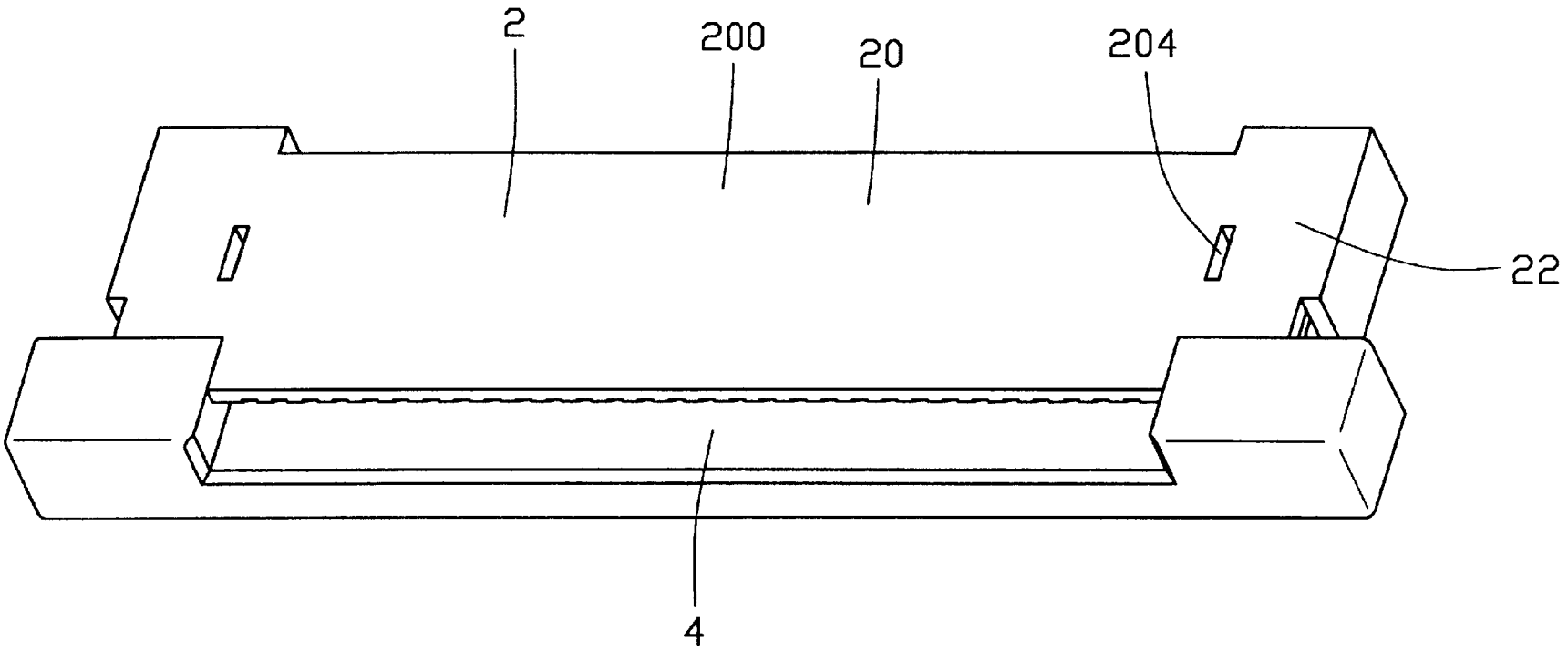
FIG. 2 is an assembled perspective view of the insulative housing and an actuator of the FFC connector of FIG. 1.

Referring to FIG. 1, an FFC connector 1 in accordance with the present invention comprises an insulative housing 2, a plurality of electrical contacts 3, an actuator 4 and a pair of mounting pads 5.

Referring also to FIGS. 2 and 8–11, the insulative housing 2 comprises a body portion 20 and a pair of shoulders 22 formed on two opposite sides of the body portion 20. The body portion 20 defines a top wall 200, a bottom wall 201 (see FIG. 5) opposite to the top wall 200, a pair of opposite side walls 202 connecting the top and the bottom walls 200, 201, and a receiving cavity 203 confined by the top, the bottom and the side walls 200, 201, 202. The top and the bottom walls 200, 201 define a plurality of parallel passageways 205 exposed to the receiving cavity 203. Each side wall 202 defines a slit 204 vertically extending through the top wall 200 and the bottom wall 201.

The shoulders 22 define a pair of guiding holes 220 extending therethrough and separated from the receiving cavity 203 by corresponding side walls 202, respectively. A stopper 221 protrudes inwardly from an inner surface 222 of an outer side 223 of each shoulder 22 into a front and lower section of the guiding hole 220 and a latch block 224 protrudes inwardly from the inner surface 222 of the outer side 223 of each shoulder 22 into a rear and upper section of the guiding hole 220. Each latch block 224 comprises a rearwardly slanting surface 226 ascending rearwardly therefrom and a forwardly slanting surface 225 descending rearwardly from an upper portion of the rearwardly slanting surface 226.

Figure 4:
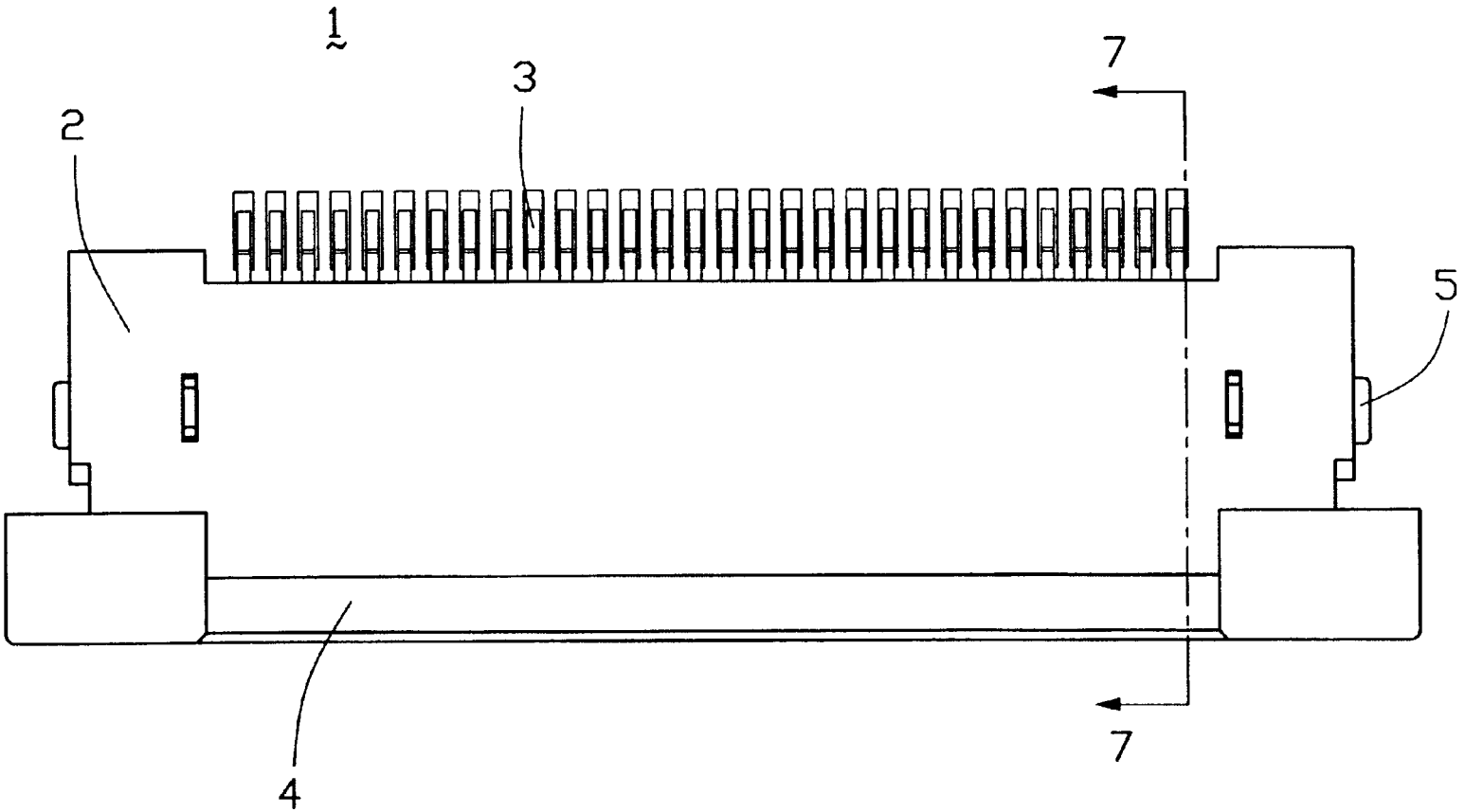
FIG. 4 is a top planar view of the assembled FFC connector of FIG. 1.
Figure 7:
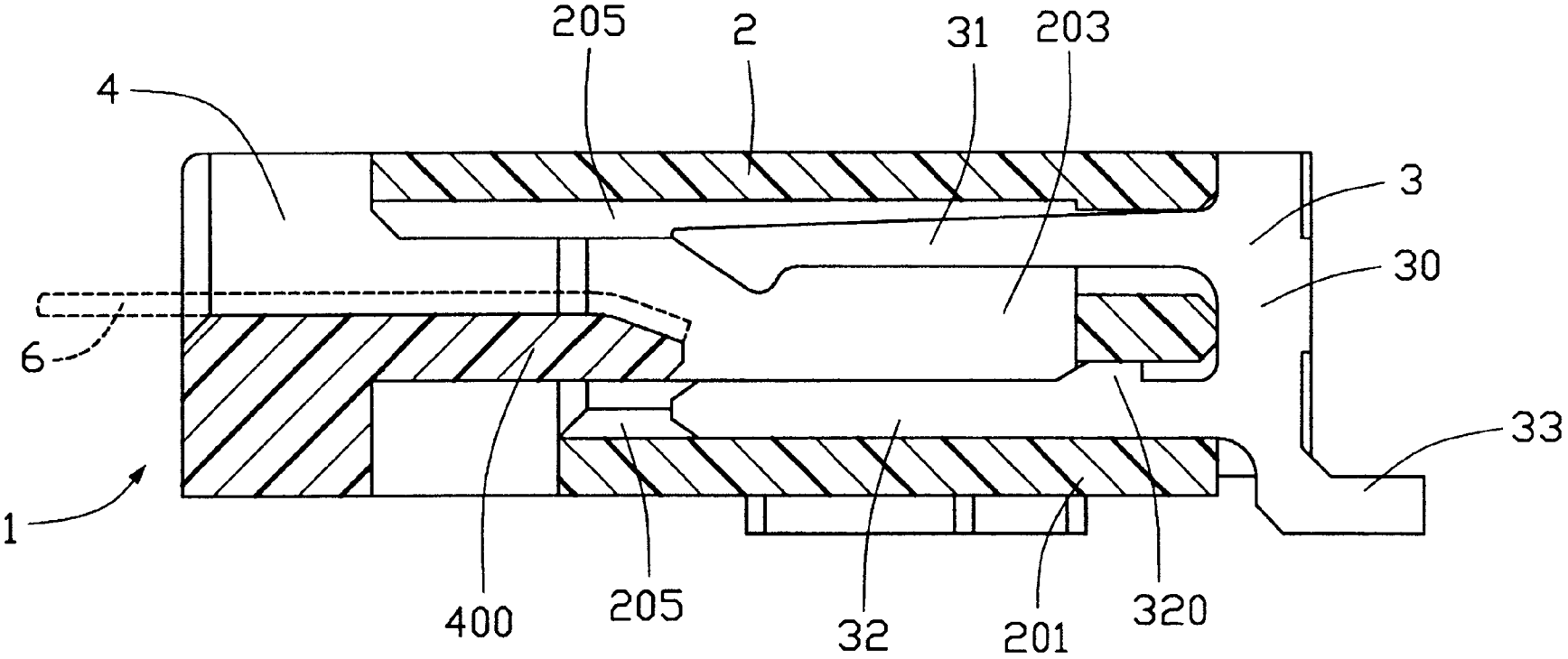
FIG. 7 is a cross-sectional view of the FFC connector at an open position and shown with presence of an FFC.
Figure 7A:
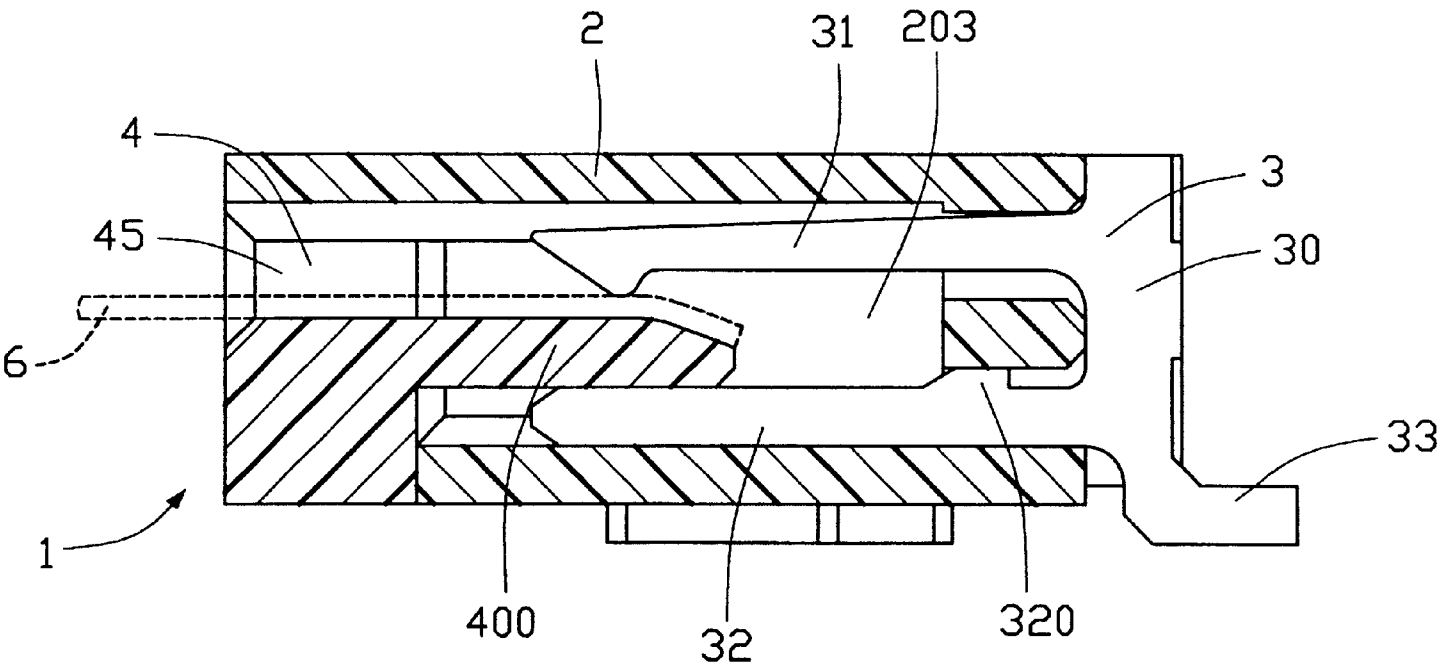
FIG. 7A is a view similar to FIG. 7 but the FFC has been inserted into the FFC connector at a closed position.
Figure 8:
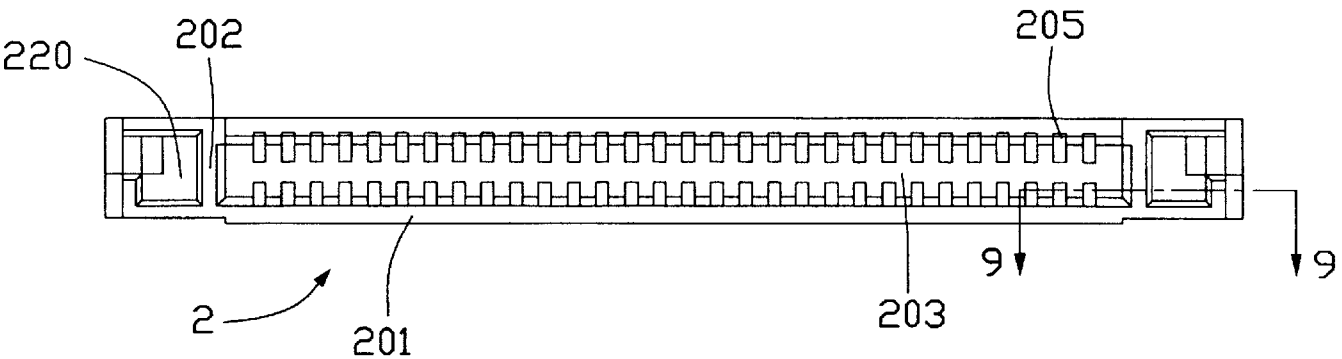
FIG. 8 is a front view of the insulative housing of the electrical connector of FIG. 1.
Figure 9:
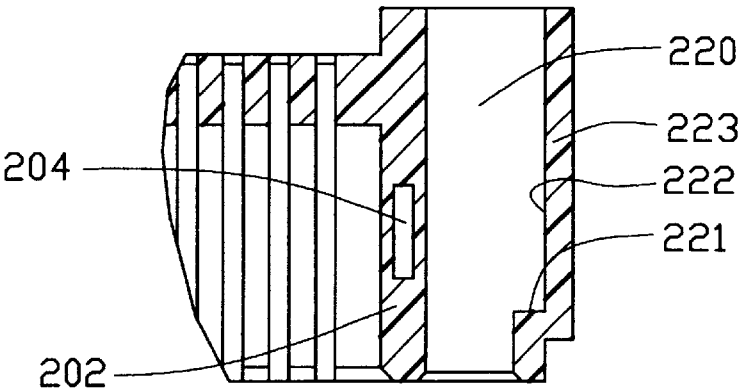
FIG. 9 is a cross-sectional view taken from line 9—9 of FIG. 8.
Figure 10:
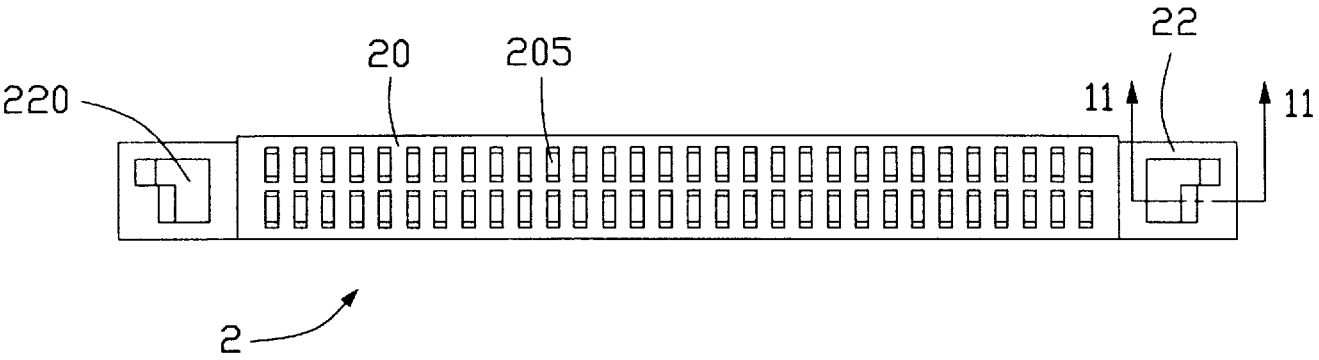
FIG. 10 is a rear planar view of the insulative housing.
Figure 11:
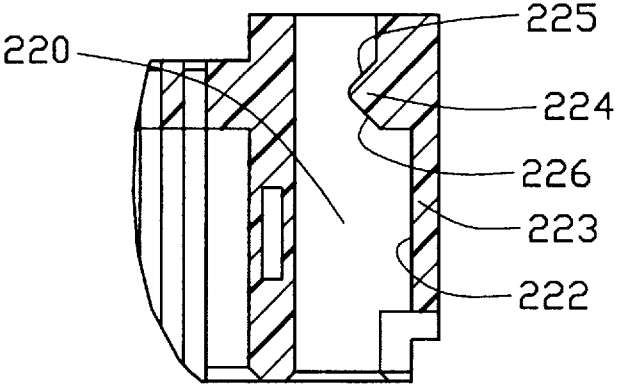
FIG. 11 is a cross-sectional view taken from line 11—11 of FIG. 10.

Referring also to FIGS. 4 and 7–7A, each electrical contact 3 comprises a mounting portion 30 mounting the electrical contact 3 to the insulative housing 2, an upper resilient arm 31, a lower resilient arm 32 and a solder tail 33. The upper and the lower resilient arms 31, 32 extend parallelly and forwardly from the mounting portion 30. The lower resilient arm 32 is formed with a barb 320 to retain the lower resilient arm 32 in the passageway 205 of the bottom wall 201 of the insulative housing 2 and the upper resilient arm 31 extends resiliently from the passageway 205 of the top wall 200 into the receiving cavity 203. The solder tail 33 extends rearwardly from a lower portion of the mounting portion 30 in a direction opposite to the upper and the lower resilient arms 31, 32 beyond the insulative housing 2 to, after soldered to a printed circuit board (not shown) to which the electrical connector 1 is mounted, mount the electrical connector 1 to the printed circuit board.

Figure 3:
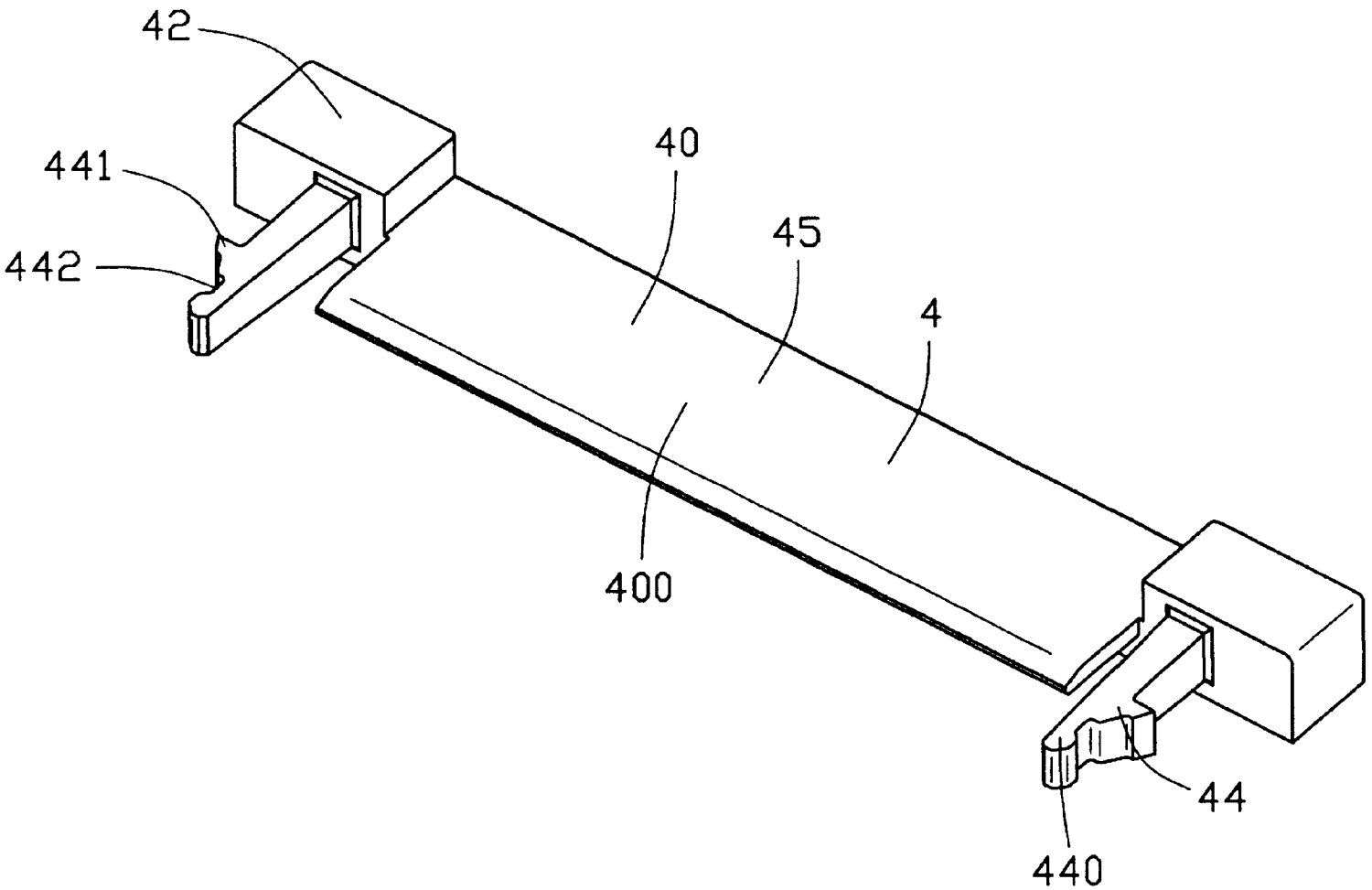
FIG. 3 is a perspective view of the actuator of the FFC connector of FIG. 1.

Referring also to FIG. 3, the actuator 4 comprises a base portion 40, a pair of blocks 42 formed on two opposite sides of the base portion 40 and a pair of side latches 44 protruding from the blocks 42. The base portion 40 comprises a tongue 400 extending rearwardly beyond the blocks 42. The blocks 42 extend vertically higher than the tongue 400 to define a receiving space 45 therebetween and above the tongue 400. Each side latch 44 extends slightly outwardly toward a free end 440 thereof and comprises an outward projection 441 adjacent to the free end 440. A recess 442 is defined between the projection 441 and the free end 440.

Each mounting pad 5 comprises a retention portion 50 and an L-shaped mounting portion 52 extending perpendicularly from the retention portion 50. The retention portion 50 is formed with a plurality of barbs 500 on opposite sides thereof. The L-shaped mounting portion 52 defines a hole 520 extending therethrough.

Figure 5:
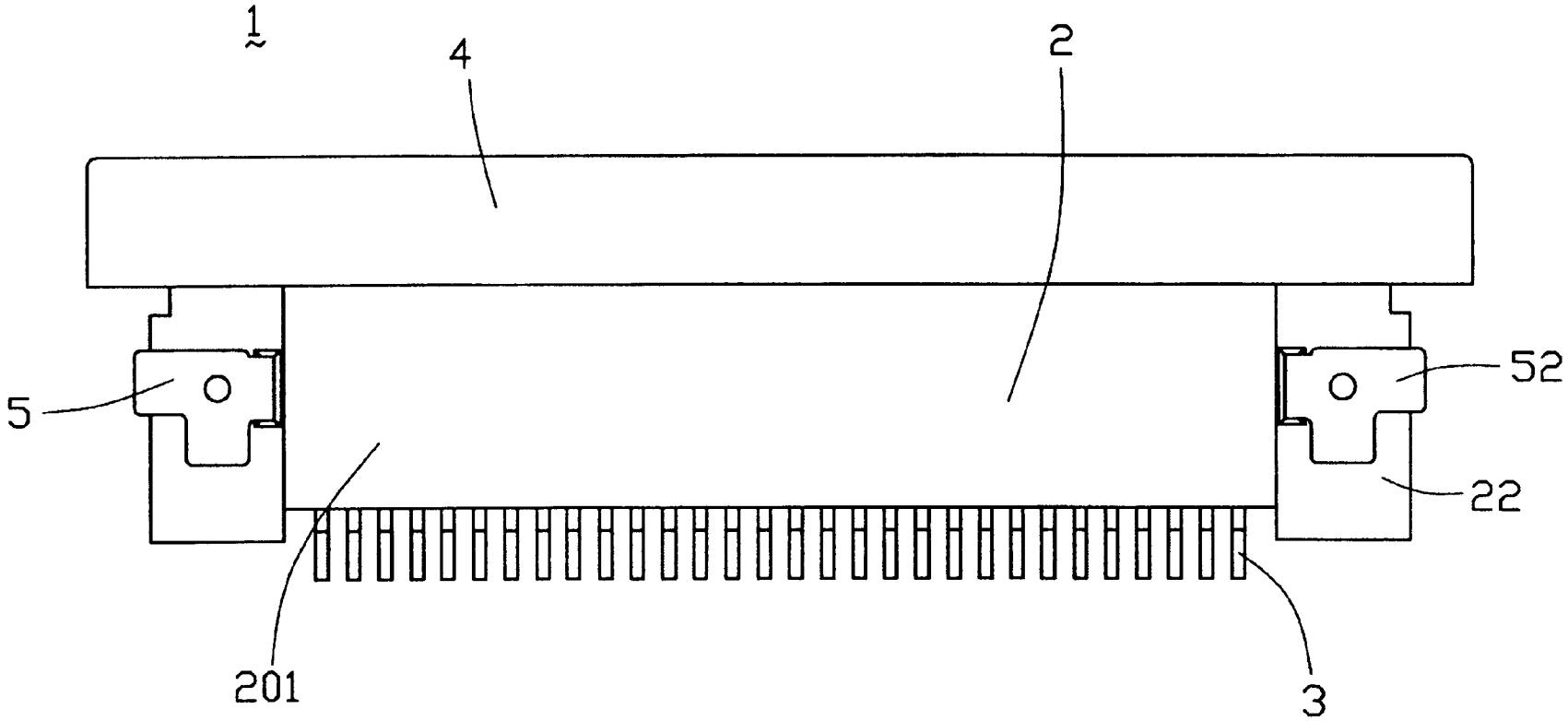
FIG. 5 is a bottom planar view of FIG. 4.
Figure 6:
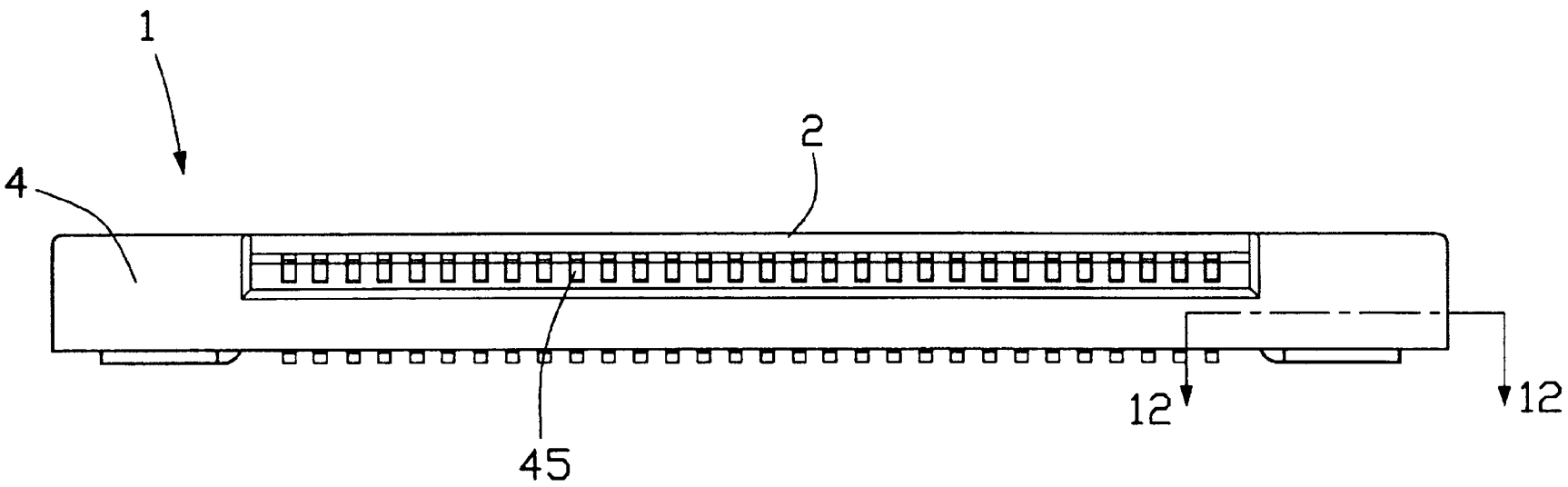
FIG. 6 is a front planar view of FIG. 4.

In assembly, the electrical contacts 3 are inserted into and retained in the insulative housing 2 in ways known to one of ordinary skill in the pertinent art. The retention portions 50 of the mounting pads 5 are retained in the slits 204 of the side walls 202 with the aid of the barbs 500. The mounting portions 52, as shown in FIG. 5, abut against bottom surfaces of the shoulders 22 and extend outwardly beyond outer lateral ends of the shoulders 22. The mounting portions 52, after soldered to the printed circuit board, reliably retain the FFC connector 1 on the printed circuit board. The side latches 44 of the actuator 4 are inserted into the guiding holes 220 of the shoulders 22 and the tongue 400 of the base portion 40 of the actuator 4 extends into the receiving cavity 203 and between the upper and the lower resilient arms 31, 32 of the electrical contacts 3.

Figure 12:
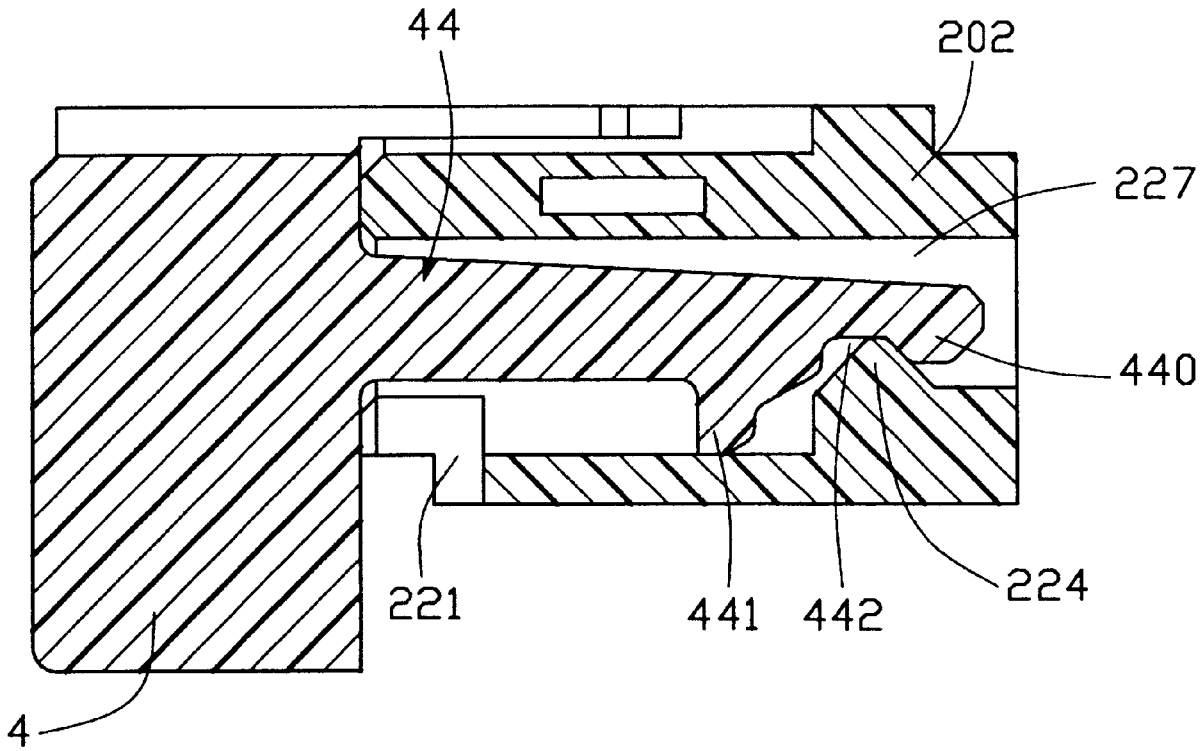
FIG. 12 is a cross-sectional view taken from line 12—12 of FIG. 6 showing that the FFC connector is at the closed position.

Referring to FIGS. 6–7A and 12–13, in use, an FFC 6, as shown in FIG. 7A, is inserted through a receiving space 45 of the actuator 4 into the receiving cavity 203 and is located between a top of the tongue 400 and the upper resilient arms 31 of the electrical contacts 3 to electrically contact with the electrical contacts 3 in ways known to persons skilled in the pertinent art. The recesses 442 of the side latches 44, as is shown in FIG. 12, engage with the latch blocks 224 to retain the FFC 6 in the FFC connector 1 and to locate the FFC connector 1 in a closed position. As is clearly shown in FIG. 12, since the side latch 44 extends slightly outwardly toward the free end 440 thereof, a gap 227 is defined between a rear portion thereof and an inner face of the side wall 202 in the closed position.

Figure 13:
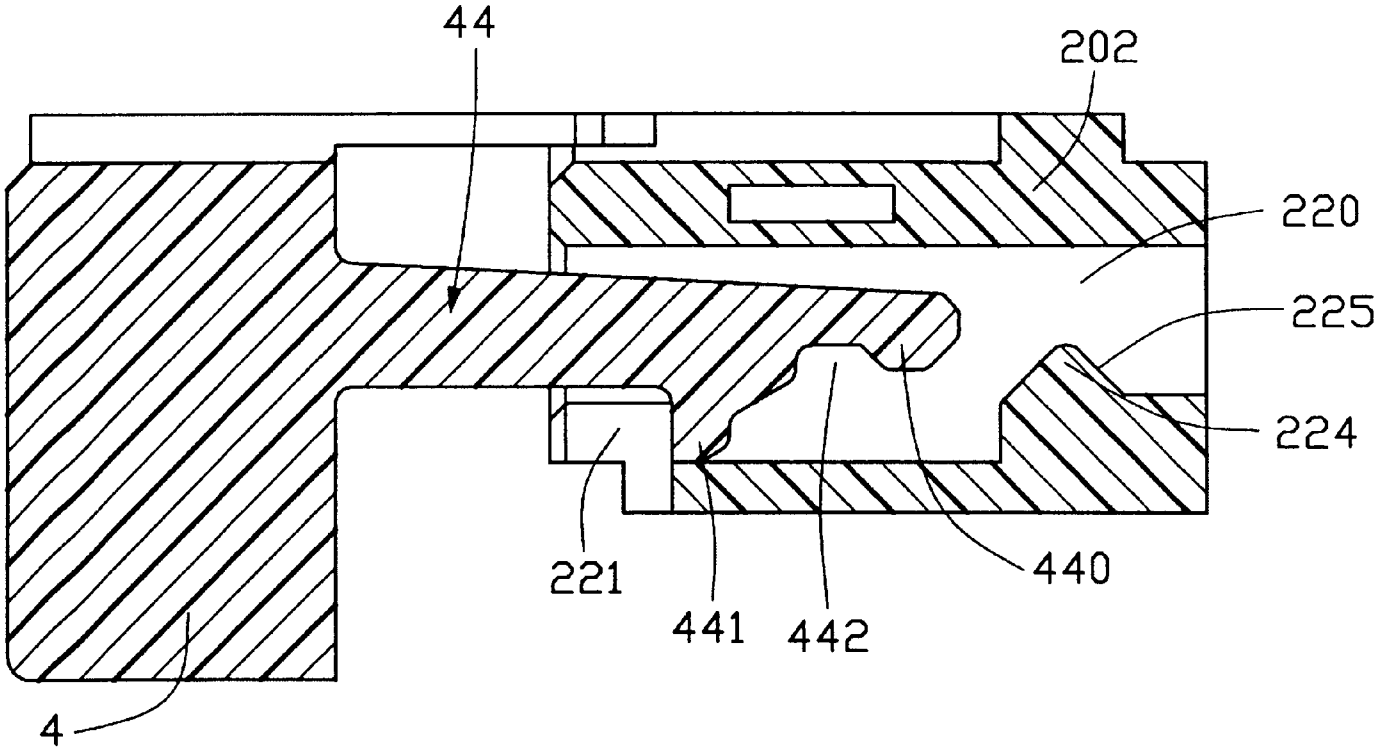
FIG. 13 is a cross-sectional view taken from line 12—12 of FIG. 6 showing that the FFC connector is at the open position.

When the FFC connector 1 is intended to be at an open position to receive the FFC 6 into or remove the FFC 6 from the receiving cavity 203, an external push force is exerted on the actuator 4 and the recesses 442 of the side latches 44 are forced to escape from the engagement with the latch blocks 224 by way of the free ends 440 sliding through the forwardly slanting surfaces 225 of the latch blocks 224 and retreating into the guiding holes 220 due to the existence of the gap 227, until the projections 441 are, as is shown in FIG. 13, engaged with the stoppers 221 to prevent the actuator 4 separating from the insulative housing 2.

Since the recesses 442 and the projections 441 of the side latches 44 engage with the latch blocks 224 and the stoppers 221 of the insulative housing 2, respectively, to locate the FFC connector 1 at the closed and the open positions, the possibility of failure of the side latches 44 is reduced and an electrical connection between the FFC 6 and the electrical contacts 3 of the FFC connector 1 is ensured. On the other hand, the recesses 442, the projections 441, the latch blocks 224 and the stoppers 221 can also be other forms so long as they could engage respectively with each other and respectively locate the FFC connector 1 in an open and a closed positions.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A flexible flat cable connector comprising:

an insulative housing defining a receiving cavity and a pair of guiding holes;

a plurality of electrical contacts being accommodated in the insulative housing, each electrical contact comprising a first arm retained to the insulative housing and a second arm extending in the receiving cavity of the insulative housing; and an actuator comprising a tongue extending into the receiving cavity for pressing an inserted flat flexible cable against the second arms of the electrical contacts, and a pair of side latches extending into the guiding holes, each side latch comprising a first portion engageable with the insulative housing to locate the flexible flat cable connector at an open position and a second portion engageable with the insulative housing to locate the flexible flat cable connector at a closed position:

wherein the first portion of each side latch is a projection adjacent to a free end thereof and the insulative housing comprises a stopper protruding into each guiding hole to engage with the projection;

wherein the second portion of each side latch is a recess defined between the projection and the free end and the insulative housing comprises a latch block protruding into each guiding hole to engage with the recess;

wherein the guiding holes are separated from the receiving cavity by a pair of side walls and a gap is defined between the side latch and the side wall when the flexible flat cable connector is located at the closed position;

further comprising a pair of mounting pads each comprising a retention portion retained to the insulative housing and a mounting portion connected to the retention portion and abutting against a bottom surface of the insulative housing, and wherein the guiding holes are separated from the receiving cavity by a pair of side walls, wherein each side wall defines a slit to retain the retention portion of the mounting pad therein, wherein the actuator comprises a pair of blocks from which the side latches extend and each side latch comprises a free end and extends outwardly toward the free end thereof.

* * * * *